US006701920B1

(12) United States Patent
Cox

(10) Patent No.: US 6,701,920 B1
(45) Date of Patent: Mar. 9, 2004

(54) HEAD ENCLOSING GAS HOOD

(76) Inventor: Gerald L. Cox, 499 W. Laurel River Dr., Shepherdsville, KY (US) 40165

( * ) Notice: Subject to any disclaimer, the term of this patent is extended or adjusted under 35 U.S.C. 154(b) by 52 days.

(21) Appl. No.: 09/585,970

(22) Filed: Jun. 2, 2000

(51) Int. Cl.[7] ..... A62B 17/04; A62B 18/00

(52) U.S. Cl. ..... 128/201.23; 128/201.22; 128/201.29; 128/206.24; 2/6.2; 2/421

(58) Field of Search ..... 128/201.22, 201.23, 128/201.25, 201.29, 206.21, 206.23, 206.24, 206.28, 207.11; 2/2.15, 5, 6.1, 6.6, 2.17, 421, 422

(56) References Cited

U.S. PATENT DOCUMENTS

| | | | | |
|---|---|---|---|---|
| 1,159,125 | A | | 11/1915 | Stelzner |
| 3,221,339 | A | | 12/1965 | Correale, Jr. |
| 3,534,408 | A | * | 10/1970 | Fifield ..... 2/2.15 |
| 3,559,209 | A | | 2/1971 | Vail |
| 3,562,813 | A | | 2/1971 | Origer |
| 3,574,862 | A | * | 4/1971 | Jones ..... 2/2.15 |
| 3,958,275 | A | | 5/1976 | Morgan et al. |
| 4,015,294 | A | | 4/1977 | O'Neill |
| 4,015,295 | A | * | 4/1977 | Lancaster et al. ..... 2/2.15 |
| 4,057,058 | A | | 11/1977 | Kovacevic |
| 4,062,079 | A | * | 12/1977 | Potter ..... 128/201.27 |
| 4,091,465 | A | | 5/1978 | Webbon et al. |
| 4,172,294 | A | | 10/1979 | Harris |
| 4,236,514 | A | | 12/1980 | Moretti |
| 4,411,264 | A | | 10/1983 | Jacobson |
| 4,452,240 | A | | 6/1984 | Moretti |
| 4,455,687 | A | | 6/1984 | Johansson |
| 4,620,538 | A | | 11/1986 | Koegel et al. |
| 4,627,431 | A | | 12/1986 | Werjefelt |
| 4,683,880 | A | | 8/1987 | Werjefelt |
| 4,889,113 | A | * | 12/1989 | Pelloux-Gervais et al. ..... 128/201.25 |
| 5,044,017 | A | * | 9/1991 | Kirby et al. ..... 2/421 |
| 5,113,854 | A | | 5/1992 | Dosch et al. |
| 5,226,409 | A | | 7/1993 | Bower et al. |
| 5,322,245 | A | | 6/1994 | Bassick |
| 5,575,278 | A | | 11/1996 | Bonhomme et al. |
| 5,819,728 | A | | 10/1998 | Ritchie |
| 5,839,432 | A | | 11/1998 | Daneshvar |
| 5,865,175 | A | | 2/1999 | Chu |

* cited by examiner

*Primary Examiner*—Weilun Lo
*Assistant Examiner*—Darwin P. Erezo
(74) *Attorney, Agent, or Firm*—John F. Salazar; James E. Cole; Middleton Reutlinger

(57) ABSTRACT

An oxygen head tent which is placeable over an individuals head for providing a gas, preferably oxygen, is described. The oxygen head tent has a hood portion which is connected to a hood ring. The hood ring slides over a two-piece neck ring, the two-piece neck ring consisting of an upper neck ring and a lower neck ring retained in adjacent relationship. The hood ring slides over the two-piece neck ring and forms a sealing relationship therewith. The two-piece neck ring has a neck seal retained therein and has a sealing ring on the outer periphery thereof for engagement with the working surface of the hood ring. Ports may be provided for directing a flow of a gas into and from the interior portion of the hood where the individuals head is located. The neck seal provides an adequate seal between the neck ring and the individuals neck such that a pressurized environment may be created in the hood. The two-piece neck ring may also have a retaining ring for holding the neck seal in place after the upper and lower neck rings are retained together.

31 Claims, 4 Drawing Sheets

HEAD ENCLOSING GAS HOOD

FIELD OF THE INVENTION

This invention relates to an oxygen head tent for covering of a persons head, and more particularly to a gas delivery hood assembly and hood ring for a head enclosing gas hood.

BACKGROUND OF THE INVENTION

A wide variety of head enclosing gas hoods have been developed for use in delivery of gas, including oxygen, to the wearer. Such a delivery system may be desirable for directing clean air or other gases into the hood for breathing by the wearer. This function is also desirable in use as a hyperbaric oxygen treatment system wherein the patient may be exposed to increased barometric pressure inside the hood device. It may be desirable to have such a head enclosing gas hood wherein the hood is transparent so the wearer can see outside of the device and so that an adequate seal is provided between the wearer and the enclosing gas hood.

In many different instances, patients must have their entire head enclosed in an oxygen rich environment, the enclosing device similar to the hood disclosed herein. It is therefor desirable to have the transparent hood surrounding the patient head and also having an efficient assembly for connecting the hood with a neck ring and a neck seal forming a seal around the patient's neck and allowing the hood area of the device to be filled with the treatment gas often times pressurized. It is therefor essential that an adequate seal be made between the hood and the hood ring retaining the hood as well as between the hood ring and the neck ring and neck seal.

Various hoods are disclosed in the prior art including U.S. Pat. No. 5,226,409, U.S. Pat. No. 4,620,538 and U.S. Pat. No. 5,819,728. In all of these prior art devices, various hood and neck ring assemblies are disclosed. However, in these designs, there is no teaching of a simplified sealing and connection system between the hood ring and the neck ring and neck seal. Some of these devices disclosed in the above-referenced patent have complex or difficult structure to ensure sealing between the neck ring and neck seal and also include structure which does not readily retain the proper pressure within the hood. It is also found in these prior art devices that after repeated wear on various surfaces of the devices, the seal between the hood and the hood ring may be corrupted. It is further noted that the prior art devices include complex or difficult attachment processes for affixing the neck seal to the neck ring or in assembly of the device. All of these shortcomings are resolved by the design of the head enclosing gas hood of the present invention

SUMMARY OF THE INVENTION

It is therefor an object of the present invention to provide a head enclosing gas hood wherein the hood is sealingly attached to a hood ring. It is a further object of the present invention to provide a neck ring wherein the hood ring is sealingly engaged with the neck ring and the neck ring further contains a neck seal which adequately seals around a patients neck.

An additional object of the present invention is to provide a two-piece neck ring for attachment and retaining of the neck seal.

It is a further object of the present invention to provide a neck seal which is attached to the neck ring and which does not require the end user to perform an assembly step and wherein the neck seal maybe securely retained within the two-piece neck ring upon shipment by the manufacturer.

A further object of the present invention is to provide a novel hood ring design wherein the attachment point between the hood and the hood ring is not located on a working and sealing surface between the hood ring and the neck ring.

An additional object of the present invention is to provide a device port through the neck ring allowing monitoring devices to be inserted into the interior portion of the gas treatment hood of the head enclosing gas hood.

An even further object of the present invention is to provide a two-piece neck ring wherein the upper and lower pieces of the neck ring may be pre-assembled and wherein the neck seal, in this pre-assembly step, is firmly retained in between the upper and lower neck rings.

These and other objects are resolved by the design of the head enclosing gas treatment hood of the present invention. The head enclosing gas treatment hood of the present invention is comprised of a hood which is affixed to a hood ring, the affixation point of the hood to the hood ring placed somewhere on the non-working surface of the hood ring. The hood ring slides over a neck ring in sealing engagement thereto. The neck ring of the present invention is a novel two-piece neck ring which has the neck seal compressed in between the upper neck ring and the lower neck ring in such a manner as to provide a sealing relationship to the interior of the hood and around the users head. The upper and lower neck ring have both a retaining O-ring and a sealing O-ring secured firmly therebetween both of which act to either retain the neck seal or firmly seal the upper and lower neck rings with the hood ring. The head enclosing gas hood of the present invention also includes a neck seal which, as discussed above, is retained between the upper neck ring and lower neck ring and which extends inwardly from the neck ring. The neck seal is made of a gas impermeable material and stretches around the users neck to seal the interior portion of the hood and allow the interior portion to be filled with the supplied gas.

One advantage of the present design is that the upper and lower neck ring may be assembled easily with the neck seal compressed therebetween. Thus, the prior art designs which require assembly of the neck ring by stretching or by retention in specially constructed rings is overcome with a simplified design which compresses the seal between the neck ring pieces.

BRIEF DESCRIPTION OF THE DRAWINGS

The head enclosing gas hood of the present invention will be more clearly understood by reference to the following detailed description and of the preferred embodiment thereof in conjunction with the accompanying drawings, in which.

DETAILED DESCRIPTION OF THE PREFERRED EMBODIMENT

Figure 1:
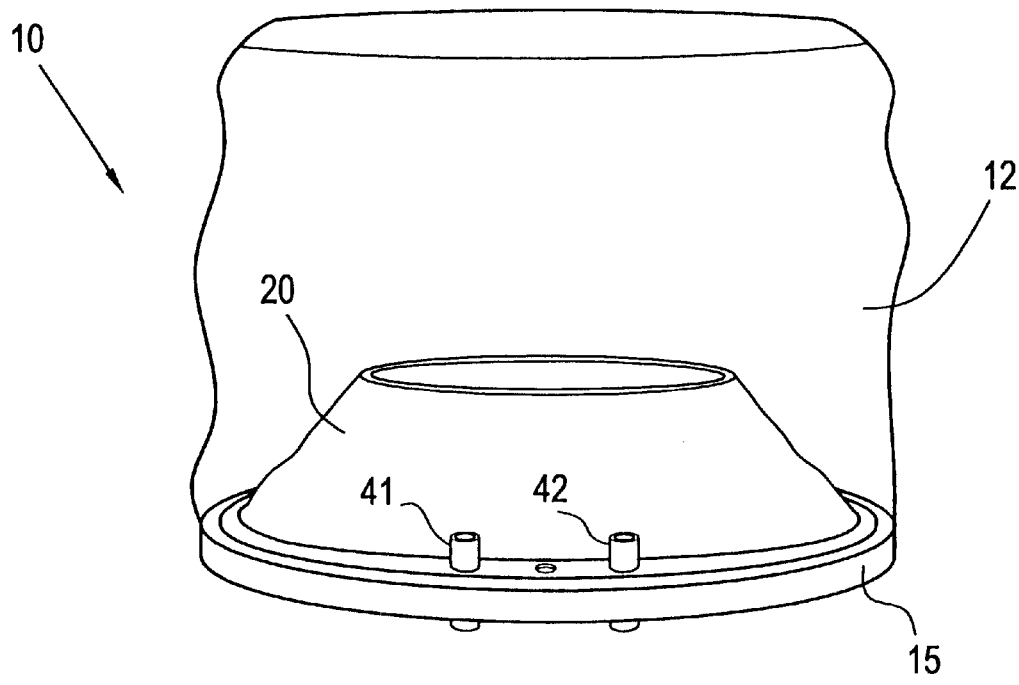
FIG. 1 is a perspective view of the head enclosing gas hood of the present invention.

The head enclosing gas hood of the present invention is showed in FIG. 1. As disclosed therein, the gas hood or head tent 10 is comprised of hood portion 12 which is affixed to a hood ring 15. The hood ring slides over the upper neck ring 46 and lower neck ring 48. Upper and lower neck rings 46 and 48 have a neck seal 20 compressed therebetween, the neck seal 20 extending inwardly therefrom. Neck seal 20 is provided so that a gas impermeable seal may be made between the hood ring 15 and upper and lower neck rings 46 and 48 and the users neck when the users head is inserted into the hood portion 12. First gas port 41 and second gas port 42 are also provided for insertion and removal of gas from within the hood portion 12. First gas port 41 and second gas port 42 extend through the upper neck ring 46 and lower neck ring 48 so that ready access is provided into the interior of the hood portion 12.

Figure 4:
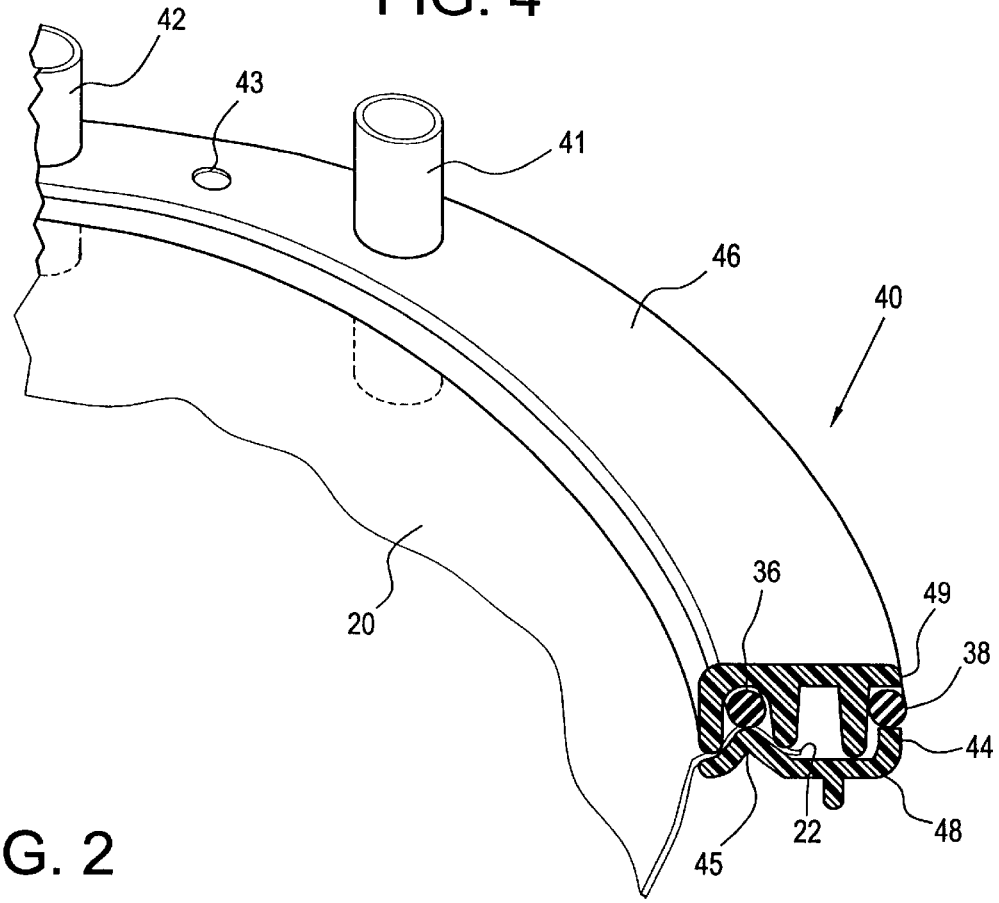
FIG. 4 is a partial sectional view of the assembled two-piece neck ring and neck seal of the present invention.

The gas hood or head tent 10 of the present invention may be utilized to provide an atmosphere for medical treatment or for the simple supply of oxygen or other gases to a patient. The patient may slide the two-piece neck ring 40 as is shown in FIG. 4, and the neck seal 20 over their head such that the individuals head is inserted into the interior of hood 12. The head tent 10 of the present invention thereby seals off the individuals head by providing access to the interior of the hood only through the first and second gas ports 41 and 42. A sealing relationship exists between the hood 12 and hood ring 15 and between the hood ring 15 and the two-piece neck ring 40. Further, the neck seal 20 is sealingly engaged between the upper and lower neck ring 46 and 48 while the neck seal 20 and the hood 12 is made of a gas impermeable material. Thus for treatment of a patient in need of a controlled specialized environment or in need of a pure oxygen or higher oxygen content breathable air, the user may slide the head tent or gas hood 10 of the present invention over their head and a supply line of the gas is placed in flow communication with the interior of hood 12 through first gas port 41. Second gas port 42 may then be utilized to provide an exit flow port of the gas contained therein.

Figure 2:
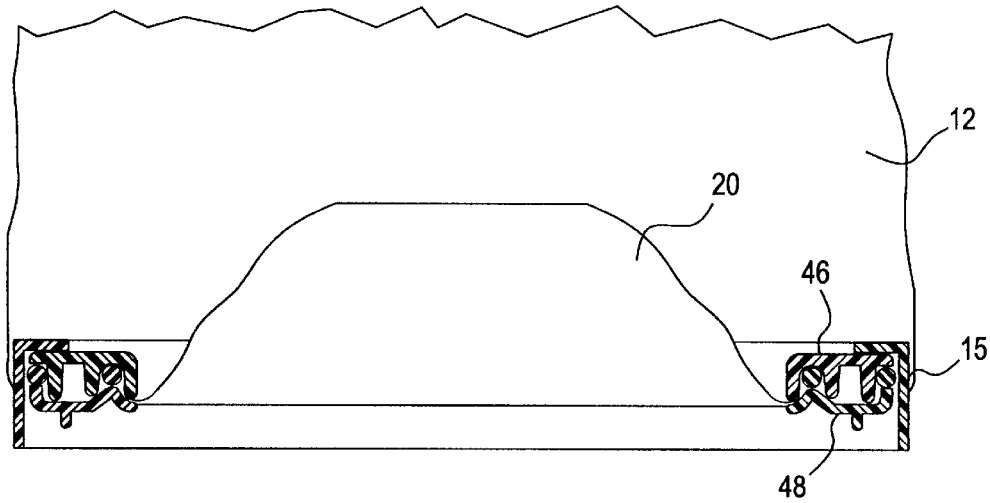
FIG. 2 is a sectional view of the head enclosing gas hood of the present invention.

One important aspect of the present invention is shown in FIG. 2 and in FIG. 4 wherein the two-piece neck ring 40 of the present invention is shown. The two-piece neck ring 40 of the present invention is comprised of an upper neck ring 46 and a lower neck ring 48 which compresses therebetween neck seal 20. Thus, upon manufacturing of the upper and lower neck rings 46 and 48 the neck seal may be assembled therebetween and the two-pieces may be sealingly engaged to each other.

A two-piece neck ring to assembly 40 as is disclosed herein is comprised of an upper neck ring 46 and a lower neck ring 48 and provides advantages for assembly of neck seal 20 in that a secure and tight seal is guaranteed between the neck seal 20 and the two-piece neck ring 40.

As is shown in FIG. 2 and in FIG. 4, the two-piece neck ring 40 is comprised of the upper neck ring and lower neck ring 46 and 48 as well as a retaining O-ring 36 and a sealing O-ring 38. The retaining O-ring 36 may be compressed between the upper and lower neck rings 46 and 48 in order to hold the neck seal 20 in place. Retaining ring 36 may be placed in an interior groove of the upper neck ring 46 and the neck seal 20 may be held in place by retaining ridge 45 which extends upwardly from the lower neck ring 48.

As is shown in FIG. 4, the neck seal periphery 22 of the neck seal 20 may be inserted into the interior portion of the two-piece neck ring 40 and may be retained in place by retaining ring 36 which will work in conjunction with retaining ridge 45 of the lower neck ring 48. The neck seal periphery 22 is thus placed into the interior of the upper and lower neck ring 46 and 48 and is thus held in place by the compressive forces of the two rings in combination with retaining ring 36. An additional sealing ring 38 may be provided on the exterior periphery of the two-piece neck ring 40 and placed in between upper neck ring edge 49 and lower neck ring edge 44 as is shown in FIG. 4. Thus, upon assembly of the two-piece neck ring 40, a slight gap will extend vertically between the upper neck ring edge 49 and lower neck ring edge 44 which receives the sealing ring 38. The sealing ring 38 extends slightly outwardly from the peripheral edge of ring 40 and may then provide a proper seal between the two-piece neck ring 40 and the hood ring 15 as is shown in FIG. 2.

In addition to the sealing structure noted above, the first gas port 41 and second gas port 42 are provided in the two-piece neck ring 40. First and second gas port 41 and 42 are cylindrical members which extend upwardly and downwardly from upper neck ring 46. Lower neck ring 48 has apertures of similar size to the diameter of the first and second gas ports 41 and 42 such that upon assembly of the two-piece neck ring 40, the downwardly extending portion of the ports 41 and 42 may extend through said apertures 31 and 32, shown in FIG. 3. Additionally, a device port 43 may be provided in both the upper neck ring 46 and lower neck ring 48 such that a monitoring device or other instrument may be inserted through two-piece neck ring 40 and into the interior of the hood 12. As previously indicated, first and second gas ports 41 and 42 provide a flow way into and out of the hood 12. Thus, a gas supply line may be affixed to the lower portion of the first gas port allowing a flow of fresh gas into the interior of hood 12. Second gas port 42 may then be utilized as an exit port for removal of the gas. A monitoring device may be inserted through the device port aperture 43 allowing the gas within hood 12 to be monitored. Thus, both the upper and lower neck rings 46 and 48 may be designed to have an aperture which are coaligned and which extend into the interior of the hood 12.

Figure 6:
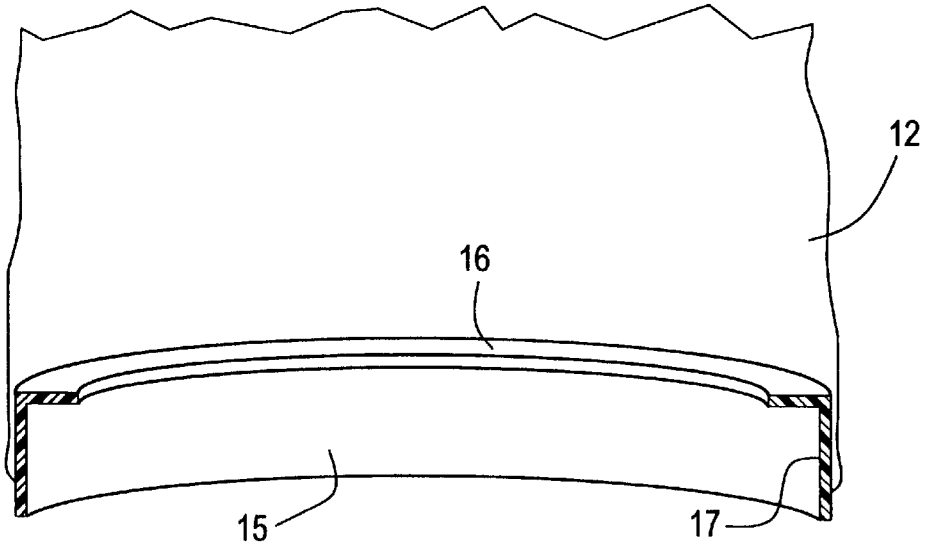
FIG. 6 is a perspective sectional view of the hood ring and hood of the present invention.

As can be seen from FIG. 2, the assembled upper and lower neck rings 46 and 48 retain the neck seal 20 in sealing relationship and allow the hood ring 15 to slide thereover. As can be seen, hood ring 15 for example, may be an inverted L-shaped ring with the hood 12 sealingly attached thereto alternative designs however are available and are within the scope of this teaching. The hood ring slides over the assembled upper and lower neck rings 46 and 48 allowing the sealing ring 38 to engage the hood ring working surface 17, as shown in FIG. 6. As shown in FIG. 2, a slight spacing in between the sealing ring 38 and the hood ring is depicted for ease of discussion. However, in actual use, the hood ring will sealingly engage the hood ring 15 to provide a gas impermeable connection between the hood ring 15 and upper and lower neck rings 46 and 48.

Figure 3:
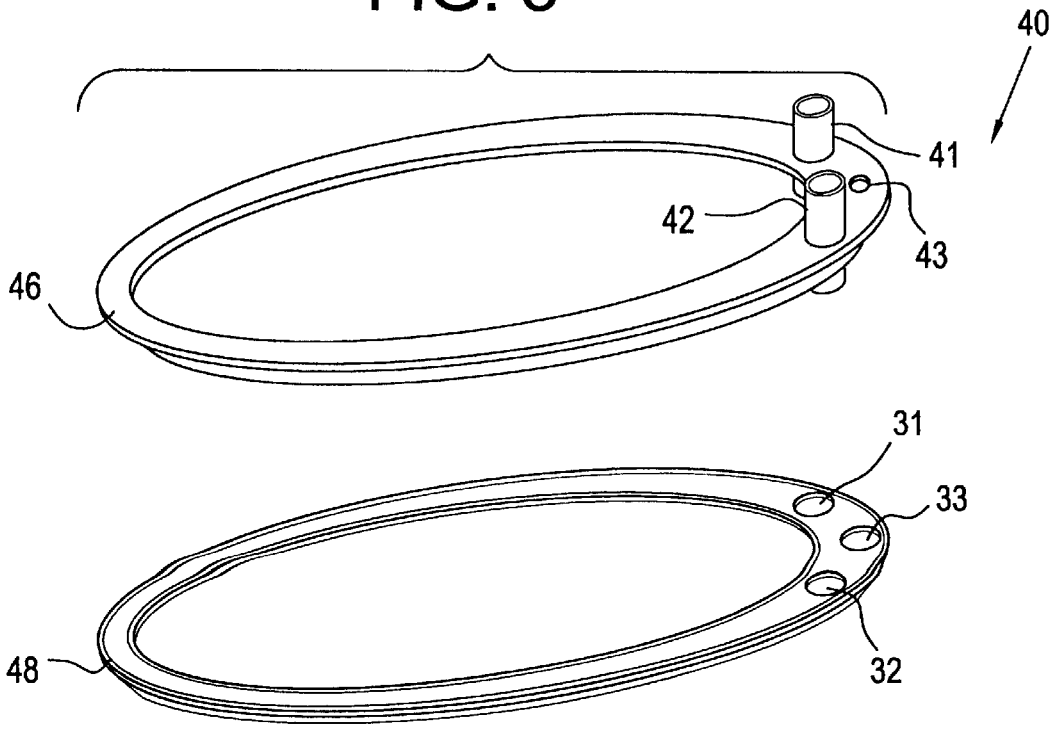
FIG. 3 is an exploded view of the two-piece neck ring of FIG.1.

Turning to FIG. 3, the two-piece neck 40 of the present invention is shown in an exploded view. The two-piece neck ring 40 is comprised of upper neck ring 46 and lower neck ring 48. Also shown therein are the cylindrical first gas port 41 and second gas port 42. Device port 43 is provided for access into the interior of hood 12. The ports 41 and 42 as depicted are cylindrical in design, but any shape may be utilized as long as a gas flow may be provided through the neck ring 40. Also as is shown in FIG. 3, first access aperture 31 and second access aperture 32 are provided such that the lower extending portion of the ports 41 and 42 may extend downward trough the lower neck ring 48 and be readily accessible. Also shown in FIG. 3 is the third access aperture 33 through which the device port 43 may be utilized. Not shown in FIG. 3 is the retaining ring 36 and the sealing ring 38 which are compressed between the upper neck ring and lower neck ring 46 and 48 upon assembly.

The upper neck ring 46 and lower neck ring 48 are compressed together thereby retaining the rings 36 and 38 therebetween. The upper and lower neck rings 46 and 48 may be held together by snap fit may be retained in compressive relationship by threaded screws or through welding, heat application or other means. Various known methods may be utilized to retain the upper and lower neck rings 46 and 48 in compressive relationship any one of which may be selected. The upper and lower neck rings 46 and 48 as well as the hood ring 15 may be made of a hardened plastic material such that they may be injection molded. It is therefor desirable that they may be made of a hardened plastic material so as to firmly hold the retaining ring 36 and sealing ring 38 in place and provide a rigid contacting surface for the rings and for the neck seal 20 to engage. It is further desirable that the hood ring 15 be able to readily slide over the exterior periphery of the two-piece neck ring 40 wherein the seal ring 38 extends slightly outward therefrom.

As shown in FIG. 6, the hood ring 15 has a working surface 17. The hood ring working surface 17 of the present invention is the interior surface of the hood ring 15 which engages the seal ring 38 of two-piece neck ring 40. The working surface 17 may extend from the top rim portion 16 of hood ring 15 and downward therefrom. The hood ring working surface 17 is that portion of the hood ring which engages the seal ring 38 of the two-piece neck ring 40. It is preferable, as is shown in FIG. 6, that the hood ring working surface 17 of hood ring 15 not have any portion of the hood 12 affixed thereto. Thus, as is shown in FIG. 6, the hood 12 is sealingly affixed to the exterior wall of the hood ring 15. The hood 12 as is shown in FIG. 6 does not cover any portion of the hood ring working surface 17. The hood ring working surface 17 thus is free to engage the seal ring 38 to provide a firm and air tight seal between two-piece neck ring 40 and the hood ring 15. Multiple variations are therefor available for affixation of the hood 12 to the hood ring 15. The hood 12 may be attached to the exterior surface of the hood ring 15 as is shown in FIG. 6 or it may affixed to a portion of the top rim 16 of ring 15. The hood 12 may therefor extend downwardly to the interior portion of the top rim 16 and be adhesively affixed to the underside of top rim 16 or it may extend downward along the exterior portion of the ring 15 as is depicted. Of import however is that the hood ring 15 have a hood ring working surface which is not encumbered by the hood 12 of the head tent 10 of the present invention.

The hood 12 of the present invention may be made of a clear plastic material which is gas impermeable. The hood 12 is preferably made of a transparent plastic so that the user may see through the hood 12. As shown in FIG. 2, the hood 12 is affixed to the exterior portion of hood ring 15 and maybe attached thereto through the use of adhesives or welding. The means of attachment of the hood 12 to the hood ring 15 may be utilized when the hood is affixed to the exterior surface of the hood ring 15 or to the underside of top rim 16 so long as the lower periphery of the hood 12 is not located on the hood ring working surface 17.

Figure 5:
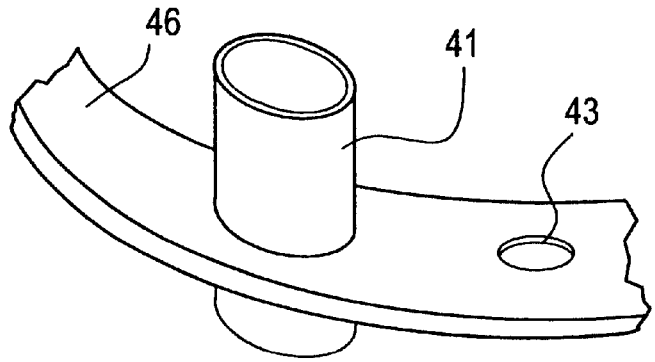
FIG. 5 is a close-up perspective view of the upper neck ring of the present invention.

The two-piece neck ring 40, shown in FIG. 4, is comprised of the upper neck ring 46 and lower neck ring 48. As indicated, the first gas port 41 is cylindrical in design and extends upwardly and downwardly from the upper neck ring 46. As shown in FIG. 5, a portion of the upper neck ring 46 is indicated with the first gas port 41 clearly depicted therein. Also shown in the closeup is the device port 43 which allows monitoring devices to be extended through the upper and lower neck rings 46 and 48 into the interior of hood 12. As shown in FIG. 5, first gas port 41 extends upwardly and downwardly from upper neck ring 46 such that the lower extension extends through the first access aperture 31 of the lower neck ring 48 shown in FIG. 3. Thus, the lower extension of the first and second gas ports 41 and 42 are readily accessible underneath the lower neck ring 48 and may be connected to an air supply and air removal system.

Figure 7:
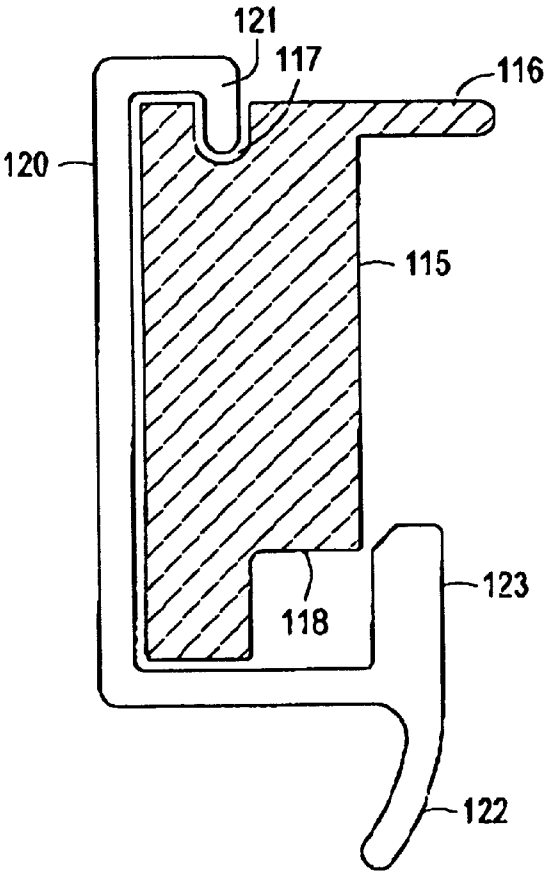
FIG. 7 is a close up sectional view of an alternative embodiment of the hood ring and neck ring of the present invention; and, FIG. 8 is a close up sectional view of and alternative embodiment of the hood ring and neck ring of the present invention with the neck ring attached thereto.

Turning to the alternative embodiment of the present invention shown in FIG. 7, the hood ring 115 may have a small annular groove 117 for receiving a locking clip 120. Locking clip 120 may be utilized to retain the hood ring 115 attached to the two piece neck ring 40. As is shown in FIG. 7, the locking clip 120 has an upper clasp 121 which extends downward and into groove 117. Clap 121 retains the clip 120 in place. Locking clip 120 may be utilized to keep the ring 115 firmly affixed to the neck ring 40 when an increased pressure is used inside hood 12. By increasing the pressure within the hood 12, downward force will be visited upon the neck ring 40 as the neck ring 40 and hood ring 115 attempt to separate. Locking clip 120, having upwardly extending retaining edge portion 123, prevents the downward movement of the neck ring 40 from occurring.

Figure 8:
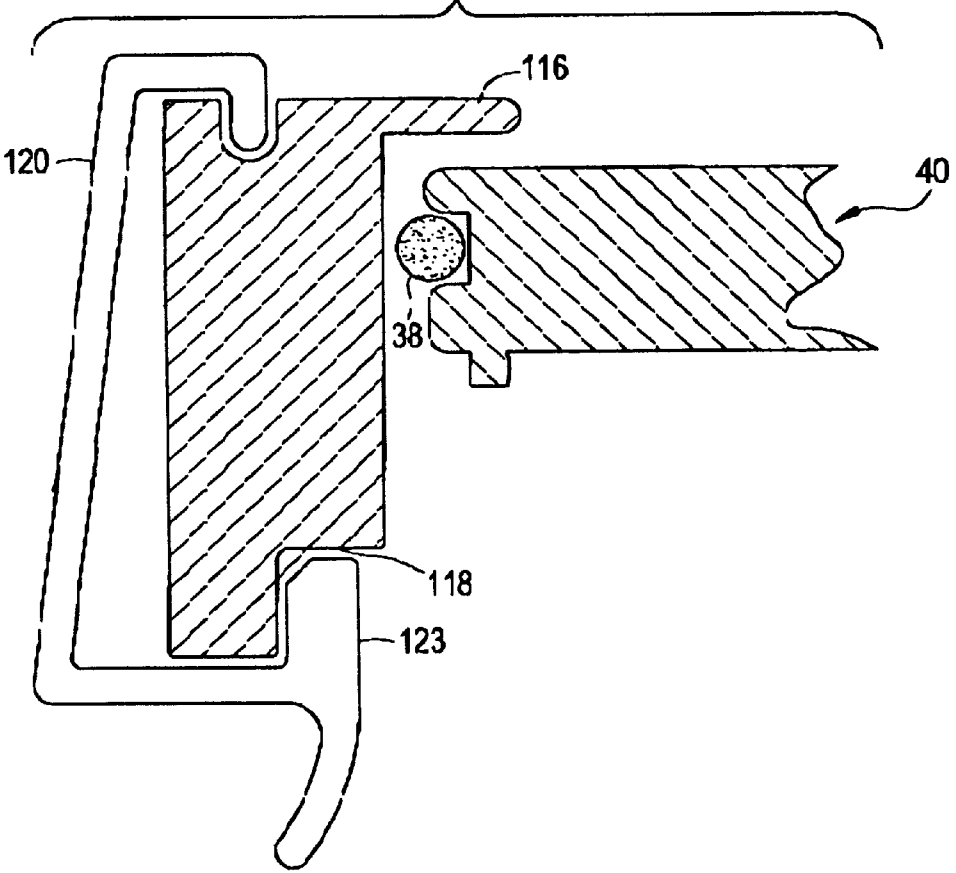

Hood ring 115 can also be modified to include recess 118 for receiving the locking clip 120 in the unlocked position as is shown in FIG. 8. The neck ring 40 may then move freely downward away from the top inwardly directed edge 116 retaining the neck ring 40 in place. Clip 120 may have grasping tongue 122 for pulling the retaining edge portion 123 away from the inner surface of the hood ring 115. Thus, FIG. 7 depicts the locking clip 120 in a fully locked position with the retaining edge portion 123 extending upwardly directly below the neck ring 40, not shown in FIG. 7. In FIG. 8, the locking clip 120 is moved into the unlocked position, allowing retaining edge 123 to be placed in the recess 118 so that the neck ring 40 can be separated from the hood ring 115.

While certain specific relationships materials and other parameters have been detailed in the above description of the preferred embodiments, these descriptions and structures may be varied where suitable with similar results. Other application variations and ramifications of the present invention will occur to those skilled in the art upon reading the present disclosure. Those are intended to be included within the scope of this invention as defined in the amended claims.

What is claimed is:

1. A head enclosing gas hood, comprising:

a hood affixed to a hood ring;

a two piece neck ring, said two piece neck ring including an upper neck ring having an upper surface and a lower surface and a lower neck ring having an upper surface and a lower surface;

wherein said upper neck ring is disposed above said lower neck ring;

continuous sealing ring compressed between said lower surface of said upper neck ring and said upper surface of said lower neck ring; and, a neck seal extending inwardly from said two piece neck ring, wherein said hood ring sealingly engages said neck ring.

2. The hood of claim 1 further comprising a retaining ring between said upper and lower neck ring, said retaining ring in engaging relationship with said neck seal.

3. The hood of claim 1 wherein said upper neck ring has a upper neck ring edge and said lower neck ring has a lower neck ring edge, said upper and lower neck ring edge separated in vertical relationship and receiving said sealing ring.

4. The hood of claim 1 wherein said hood ring is adjacent said sealing ring.

5. The hood of claim 4 wherein said hood ring is comprised of an inverted L-shape ring having a depending side wall and an inwardly directed top rim.

6. The hood of claim 1 wherein said hood ring has a first gas port and a second gas port extending through said neck ring.

7. The hood of claim 6 wherein said hood ring is further comprised of a device port extending through said neck ring.

8. The hood of claim 6 wherein said first and second gas port are formed on said upper neck ring.

9. The hood of claim 10 wherein said first and second gas port are comprised of an upwardly and downwardly extending cylindrical wall.

10. The hood of claim 9 wherein said lower neck ring have a first and second access aperture which receive said first and second gas port.

11. The hood of claim 1 further comprising an attachment clip removably retained on said hood ring and retaining said neck ring to said hood ring.

12. The hood of claim 11 wherein said attachment clip extends inwardly from said hood ring.

13. The hood of claim 14 further comprising:

an annular groove formed in said hood ring;

a downwardly extending clasp on said attachment clip resting within said annular groove;

wherein said attachment clip extends around said hood ring from said clasp, said clip having a retaining edge portion at the opposite end from said clasp and extending inwardly from said hood ring.

14. A head enclosing gas hood, comprising:

a hood affixed to a ring;

a substantially rigid two piece neck ring, said two piece neck ring having an upper neck ring including an upper surface and a lower surface and a lower neck ring having an upper surface and a lower surface;

wherein said upper neck ring is disposed above said lower neck ring;

a nec seal extending inwardly from said two piece neck ring, wherein said hood ring sealingly engages said substantially rigid neck ring; and a sealing ring compressed between said lower surface of said upper neck ring and said upper surface of said lower neck ring, wherein said lower neck ring has an upwardly directd retaining ridge, said ridge in compressive relationship with a retaining ring.

15. The hood of claim 14 wherein said neck seal has a neck seal periphery, said periphery adjacent to said retaining ring and held thereby.

16. An oxygen head tent, comprising:

a hood adhered to a hood ring;

a substantially rigid two-piece neck ring,said two piece neck ring comprising an upper neck ring having an upper surface and a lower surface and a lower neck ring having an upper surface and a lower surface, wherein said upper neck ring is disposal above said lower neck ring;

a neck seal extending inwardly from said two piece neck ring; and a sealing mechanism compressed between said lower surface of said upper neck ring and said upper surface of said lower neck ring.

17. The head tent of claim 16 further comprising a retaining mechanism between said upper and lower neck ring and in frictional engagement with said neck seal.

18. The head tent of claim 16 wherein said upper and lower neck ring each have an outer edge, said outer edges of said upper and lower neck ring having a space therebetween, said sealing mechanism located within said space.

19. The head tent of claim 18 wherein said sealing mechanism is an O-ring seal.

20. The head tent of claim 19 wherein said O-ring engages said hood ring.

21. The head tent of claim 16 wherein said hood ring is comprised of an inverted L-shaped ring.

22. The head tent of claim 21 wherein said hood ring has an outer surface, said hood affixed to said outer surface of said hood ring.

23. The head tent of claim 22 wherein said hood is retained on said hood ring by adhesive.

24. The head tent of claim 22 wherein said hood is retained on said hood by welding.

25. The head tent of claim 16 further having a gas supply port which is a cylindrical port extending upwardly and downwardly from said upper neck ring.

26. The head tent of claim 25 wherein said lower neck ring has an aperture through which said cylindrical port extends through.

27. The head tent of claim 26 further comprising a second gas supply port and a device port formed in said substantially rigid neck ring.

28. The head tend of claim 16 further comprising an attachment clasp extending around said hood ring and extending inwardly therefrom.

29. The head tent of claim 16 wherein said hood ring engages said substantially rigid neck ring along a hood ring working surface.

30. The head tent of claim 29 wherein said hood is not affixed to said hood ring working surface of said hood ring.

31. The hood and hood ring of claim 29 wherein said hood is affixed to said hood ring on a top rim.

* * * * *